US005942990A

United States Patent [19]

Smith et al.

[11] Patent Number: 5,942,990

[45] Date of Patent: Aug. 24, 1999

[54] ELECTROMAGNETIC SIGNAL REPEATER AND METHOD FOR USE OF SAME

[75] Inventors: Harrison C. Smith, Anna; Paul D. Ringgenberg, Carrollton, both of Tex.

[73] Assignee: Halliburton Energy Services, Inc., Dallas, Tex.

[21] Appl. No.: 08/957,299

[22] Filed: Oct. 24, 1997

[51] Int. Cl.[6] ..... G01V 1/00

[52] U.S. Cl. ..... 340/853.7; 340/854.4; 340/853.1; 166/64; 324/342

[58] Field of Search ..... 340/854.4, 855.4, 340/853.1, 853.7; 324/323, 342; 166/64

[56] References Cited

U.S. PATENT DOCUMENTS

| | | | |
|---|---|---|---|
| 2,379,800 | 7/1945 | Hare | 175/356 |
| 2,411,696 | 11/1946 | Silverman et al. | 177/352 |
| 3,186,222 | 6/1965 | Martin | 73/151 |
| 3,205,477 | 9/1965 | Kalbfell | 340/18 |
| 3,333,239 | 7/1967 | Silverman | 340/18 |
| 3,930,220 | 12/1975 | Shawhan | 340/18 FM |
| 4,019,148 | 4/1977 | Shawhan | 328/167 |
| 4,087,781 | 5/1978 | Grossi et al. | 340/18 NC |
| 4,181,014 | 1/1980 | Zuvela et al. | 73/151 |
| 4,215,426 | 7/1980 | Klatt | 367/83 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,757 | 11/1981 | Still | 340/854 |
| 4,348,672 | 9/1982 | Givier | 340/854 |
| 4,363,137 | 12/1982 | Salisbury | 445/40 |
| 4,387,372 | 6/1983 | Smith et al. | 340/854 |
| 4,406,919 | 9/1983 | Pospischil | 178/69 G |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,562,559 | 12/1985 | Sharp et al. | 367/82 |
| 4,578,675 | 3/1986 | Mac Leoad | 340/853.7 |
| 4,584,675 | 4/1986 | Peppers | 340/853.7 |
| 4,616,702 | 10/1986 | Hanson et al. | 166/65.1 |
| 4,684,946 | 8/1987 | Issenmann | 340/855.4 |
| 4,691,203 | 9/1987 | Rubin et al. | 340/856 |
| 4,725,837 | 2/1988 | Rubin | 340/855 |
| 4,739,325 | 4/1988 | MacLeod | 340/854 |
| 4,757,157 | 7/1988 | Pelet | 174/50 |
| 4,766,442 | 8/1988 | Issenmann | 343/719 |
| 4,788,544 | 11/1988 | Howard | 340/853.7 |
| 4,800,570 | 1/1989 | Perrotta et al. | 375/4 |
| 4,839,644 | 6/1989 | Safinya et al. | 340/854 |
| 4,845,493 | 7/1989 | Howard | 340/853 |
| 4,845,494 | 7/1989 | Hanson | 340/854.4 |
| 4,901,069 | 2/1990 | Veneruso | 340/853 |
| 4,908,804 | 3/1990 | Rorden | 367/81 |
| 4,914,433 | 4/1990 | Galle | 340/854.4 |
| 4,933,640 | 6/1990 | Kuckes | 324/339 |
| 4,968,978 | 11/1990 | Stolarczyk | 340/854 |
| 5,087,099 | 2/1992 | Stolarczyk | 299/1 |
| 5,130,706 | 7/1992 | Van Steenwyk | 340/854.6 |

(List continued on next page.)

FOREIGN PATENT DOCUMENTS 0 672 819 A2 9/1995 Norway .

*Primary Examiner*—Michael Horabik
*Assistant Examiner*—Albert K. Wong
*Attorney, Agent, or Firm*—Lawrence R. Youst; Paul I. Herman

[57] ABSTRACT

A downhole electromagnetic signal repeater (76) for communicating information between surface equipment and downhole equipment and a method for use of the repeater (76) is disclosed. The repeater (76) comprises a receiver (120) and a transmitter (124). The receiver (120) receives an electromagnetic input signal and transforms the electromagnetic input signal to an electrical signal that is inputted into an electronics package (122) that amplifies the electrical signal and forwards the electrical signal to the transmitter (124) that transforms the electrical signal to an electromagnetic output signal that is radiated into the earth.

48 Claims, 7 Drawing Sheets

U.S. PATENT DOCUMENTS

| | | | |
|---|---|---|---|
| 5,160,925 | 11/1992 | Dailey et al. | 340/853.3 |
| 5,268,683 | 12/1993 | Stolarczyk | 340/854.4 |
| 5,394,141 | 2/1995 | Soulier | 340/854.4 |
| 5,396,232 | 3/1995 | Mathieu et al. | 340/854.5 |
| 5,448,227 | 9/1995 | Orban et al. | 340/854.4 |
| 5,467,083 | 11/1995 | McDonald et al. | 340/854.6 |
| 5,467,832 | 11/1995 | Orban et al. | 175/45 |
| 5,493,288 | 2/1996 | Henneuse | 340/854.4 |
| 5,530,358 | 6/1996 | Wisler et al. | 324/338 |
| 5,576,703 | 11/1996 | MacLeod et al. | 340/854.4 |
| 5,583,504 | 12/1996 | Huggett | 342/15 |

ELECTROMAGNETIC SIGNAL REPEATER AND METHOD FOR USE OF SAME

TECHNICAL FIELD OF THE INVENTION

This invention relates in general to downhole telemetry and, in particular to, an electromagnetic signal repeater for communicating electromagnetic signals carrying information between surface equipment and downhole equipment.

BACKGROUND OF THE INVENTION

Without limiting the scope of the invention, its background is described in connection with transmitting downhole data to the surface during measurements while drilling (MWD), as an example. It should be noted that the principles of the present invention are applicable not only during drilling, but throughout the life of a wellbore including, but not limited to, during logging, testing, completing and producing the well.

Heretofore, in this field, a variety of communication and transmission techniques have been attempted to provide real time data from the vicinity of the bit to the surface during drilling. The utilization of MWD with real time data transmission provides substantial benefits during a drilling operation. For example, continuous monitoring of downhole conditions allows for an immediate response to potential well control problems and improves mud programs.

Measurement of parameters such as bit weight, torque, wear and bearing condition in real time provides for a more efficient drilling operations. In fact, faster penetration rates, better trip planning, reduced equipment failures, fewer delays for directional surveys, and the elimination of a need to interrupt drilling for abnormal pressure detection is achievable using MWD techniques.

At present, there are four major categories of telemetry systems that have been used in an attempt to provide real time data from the vicinity of the drill bit to the surface, namely mud pressure pulses, insulated conductors, acoustics and electromagnetic waves.

In a mud pressure pulse system, the resistance of mud flow through a drill string is modulated by means of a valve and control mechanism mounted in a special drill collar near the bit. This type of system typically transmits at 1 bit per second as the pressure pulse travels up the mud column at or near the velocity of sound in the mud. It has been found, however, that the rate of transmission of measurements is relatively slow due to pulse spreading, modulation rate limitations, and other disruptive limitations such as the requirement of mud flow.

Insulated conductors, or hard wire connection from the bit to the surface, is an alternative method for establishing downhole communications. This type of system is capable of a high data rate and two way communication is possible. It has been found, however, that this type of system requires a special drill pipe and special tool joint connectors which substantially increases the cost of a drilling operation. Also, these systems are prone to failure as a result of the abrasive conditions of the mud system and the wear caused by the rotation of the drill string.

Acoustic systems have provided a third alternative. Typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission.

The fourth technique used to telemeter downhole data to the surface uses the transmission of electromagnetic waves through the earth. A current carrying downhole data are input to a toroid or collar positioned adjacent to the drill bit or input directly to the drill string. When a toroid is utilized, a primary winding, carrying the data for transmission, is wrapped around the toroid and a secondary is formed by the drill pipe. A receiver is connected to the ground at the surface where the electromagnetic data is picked up and recorded. It has been found, however, that in deep or noisy well applications, conventional electromagnetic systems are unable to generate a signal with sufficient intensity to reach the surface.

Therefore, a need has arisen for a system that is capable of telemetering real time data from the vicinity of the drill bit in a deep or noisy well using electromagnetic waves to carry the information to the surface. A need has also arisen for an electromagnetic signal repeater that utilizes an electromagnetic receiver and an electromagnetic transmitter to amplify the electromagnetic signals carrying information to alleviate the signal attenuation and noise problem. Further, a need has arisen for such a system that is capable of withstanding the severe tension, compression, torsion, column bending, shock and jar loads as well as the severe temperature range which is encountered during a drilling operation.

SUMMARY OF THE INVENTION

The present invention disclosed herein comprises a electromagnetic signal repeater apparatus that utilizes an electromagnetic receiver and an electromagnetic transmitter to amplify electromagnetic signals carrying information and a method for use of the same. The apparatus and method of the present invention provide for real time communication between downhole equipment and the surface and for the telemetering of information and commands from the surface to downhole tools disposed in a well using electromagnetic waves to carry information. The apparatus and method of the present invention amplify the electromagnetic signals at various locations on the drill string, thereby alleviating signal attenuation. The apparatus and method of the present invention are operable in the severe tension, compression, torsion, column bending, shock and jar load environments as well as in the severe temperature ranges which are encountered downhole.

The downhole electromagnetic signal repeater of the present invention comprises a housing having first and second subassemblies that are electrically isolated from one another. In one embodiment, an isolation subassembly is disposed between the first and second subassemblies using a dielectric layer positioned between the isolation subassembly and both the first subassembly and the second subassembly. The repeater also includes a mandrel that is coaxially disposed within the housing. The mandrel is electrically isolated from the first subassembly by positioning a dielectric member therebetween and electrically connected to the second subassembly. In one embodiment, the mandrel includes a first section and a second section which are electrically isolated from one another by a dielectric material.

In one embodiment, the repeater uses a receiver that is coaxially disposed between the housing and the mandrel to receive electromagnetic input signals and transform these electromagnetic input signals into electrical signals. The receiver includes a magnetically permeable annular core having a plurality of primary electrical conductor windings and a plurality of secondary electrical conductor windings wrapped therearound. The electrical signals from the receiver are fed to an electronics package for amplifying. After processing, the electrical signals are then fed to a transmitter that transforms the electrical signals to electromagnetic output signals that are radiated into the earth.

In another embodiment, the receiver and the transmitter each include a magnetically permeable annular core having a plurality of primary and secondary electrical conductor windings wrapped axially therearound. In another embodiment, a single magnetically permeable annular core having primary and secondary electrical conductor windings serves as both the receiver and the transmitter. In yet another embodiment, the transmitter is directly connected to the drill string to produce the electromagnetic output signals.

In the method of the present invention, the receiver receives an electromagnetic input signal and transforms the electromagnetic input signal to an electrical signal. The electrical signal is sent to the electronics package where it is filtered and amplified. The electrical signal is then sent to the transmitter. In one embodiment, the transmitter is a direct connect to the drill string that produces an electromagnetic output signal. In another embodiment, the transmitter transforms the electrical signal to an electromagnetic output signal. In either embodiment, the electromagnetic output signal is radiated into the earth to carry the information to a subsequent repeater or the final surface or downhole destination of the information.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
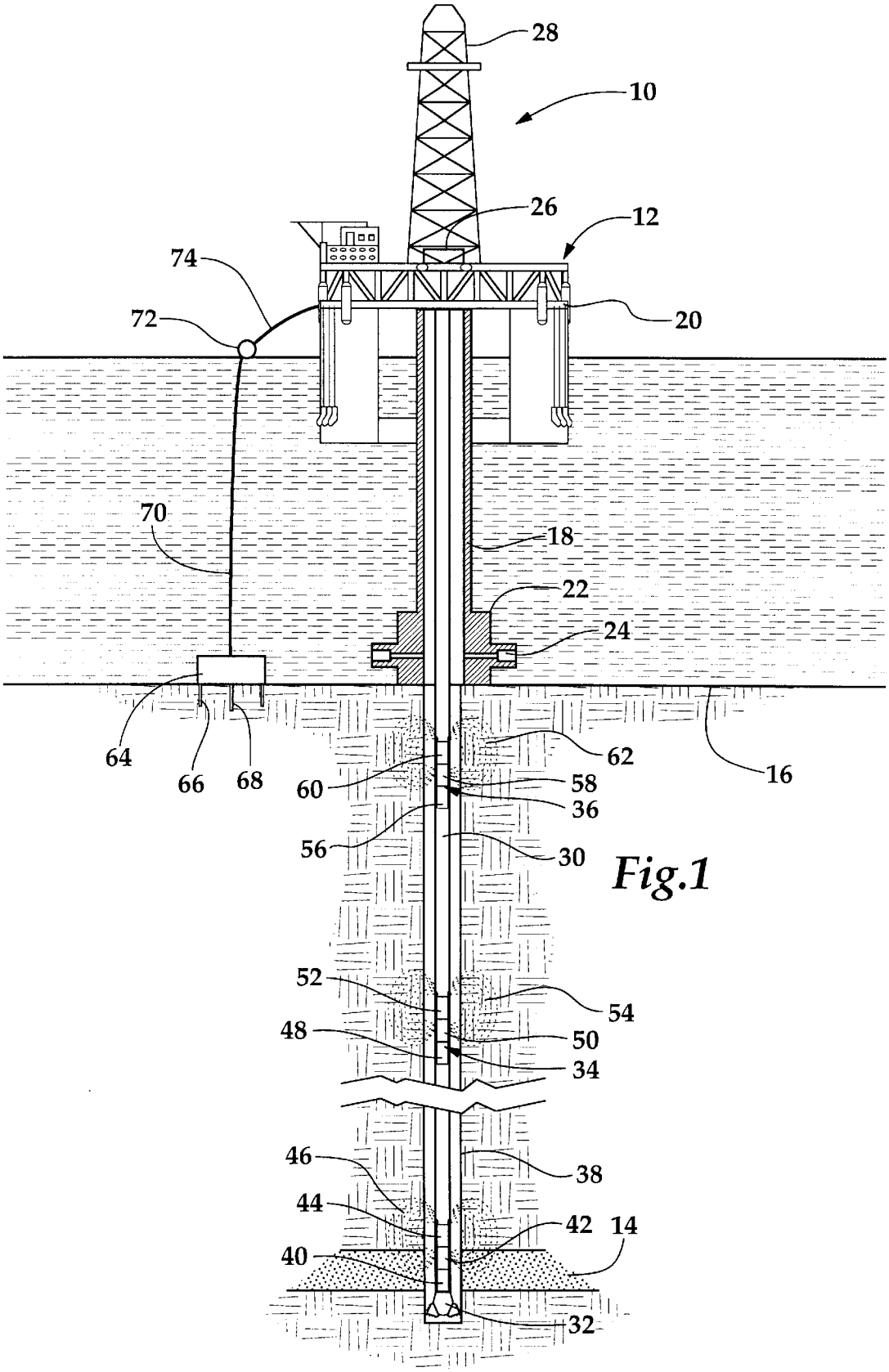
FIG. 1 is a schematic illustration of an offshore oil or gas drilling platform operating two electromagnetic signal repeaters of the present invention.

Referring to FIG. 1, a plurality of electromagnetic signal repeaters in use on an offshore oil and gas drilling platform is schematically illustrated and generally designated 10. A semi-submergible platform 12 is centered over a submerged oil and gas formation 14 located below sea floor 16. A subsea conduit 18 extends from deck 20 of platform 12 to wellhead installation 22 including blowout preventers 24. Platform 12 has a derrick 26 and a hoisting apparatus 28 for raising and lowering drill string 30, including drill bit 32 and electromagnetic signal repeaters 34, 36.

In a typical drilling operation, drill bit 32 is rotated by drill string 30, such that drill bit 32 penetrates through the various earth strata, forming wellbore 38. Measurement of parameters such as bit weight, torque, wear and bearing conditions may be obtained by sensors 40 located in the vicinity of drill bit 32. Additionally, parameters such as pressure and temperature as well as a variety of other environmental and formation information may be obtained by sensors 40. The signal generated by sensors 40 may typically be analog, which must be converted to digital data before electromagnetic transmission in the present system. The signal generated by sensors 40 is passed into an electronics package 42 including an analog to digital converter which converts the analog signal to a digital code utilizing "1" and "0" for information transmission.

Electronics package 42 may also include electronic devices such as an on/off control, a modulator, a microprocessor, memory and amplifiers. Electronics package 42 is powered by a battery pack which may include a plurality of batteries, such as nickel cadmium or lithium batteries, which are configured to provide proper operating voltage and current.

Once the electronics package 42 establishes the frequency, power and phase output of the information, electronics package 42 feeds the information to transmitter 44. Transmitter 44 may be a direct connect to drill string 30 or may electrically approximate a large transformer. The information is then carried uphole in the form of electromagnetic wave fronts 46 which travel through the earth. These electromagnetic wave fronts 46 are picked up by a receiver 48 of repeater 34 located uphole from transmitter 44.

Receiver 48 of repeater 34 is spaced along drill string 30 to receive the electromagnetic wave fronts 46 while electromagnetic wave fronts 46 remain strong enough to be readily detected. Receiver 48 may electrically approximate a large transformer. As electromagnetic wave fronts 46 reach receiver 48, a current is induced in receiver 48 that carries the information originally obtained by sensors 40.

The current is fed to an electronics package 50 that may include a variety of electronic devices such as a preamplifier, a limiter, a plurality of filters, a frequency to voltage converter, a voltage to frequency converter and amplifiers as will be further discussed with reference to FIGS. 9 and 11. Electronics package 50 cleans up and amplifies the signal to reconstruct the original waveform, compensating for losses and distortion occurring during the transmission of electromagnetic wave fronts 46 through the earth.

Electronics package 50 is coupled to a transmitter 52 that radiates electromagnetic wave fronts 54 in the manner described with reference to transmitter 44 and electromagnetic wave fronts 46. Electromagnetic wave fronts 54 travel through the earth and are eventually picked up by receiver 56 of repeater 36. Repeater 36 includes receiver 56, electronics package 58, and transmitter 60 each of which operate in a manner as described with reference to repeater 34, receiver 48, electronics package 50, and transmitter 52. Thus, after electromagnetic wave fronts 54 are received by receiver 56 and processed by electronics package 58, the information is passed to transmitter 60 that radiates electromagnetic wave fronts 62 into the earth.

Even though FIG. 1 depicts two repeaters 34, 36, it should be noted by one skilled in the art that the number of repeaters located within drill string 30 will be determined by the depth of wellbore 38, the noise level in wellbore 38 and the characteristics of the earth's strata adjacent to wellbore 38 in that electromagnetic waves suffer from attenuation with increasing distance from their source at a rate that is dependent upon the composition characteristics of the transmission medium and the frequency of transmission. For example, repeaters 34, 36 may be positioned between 3,000 and 5,000 feet apart. Thus, if wellbore 38 is 15,000 feet deep, between two and four repeaters such as repeaters 34, 36 would be desirable.

Electromagnetic wave fronts 62 travel through the earth and are received by electromagnetic pickup device 64 located on sea floor 16. Electromagnetic pickup device 64 may sense either the electric field or the magnetic field of electromagnetic wave front 62 using an electric field sensor 66 or a magnetic field sensor 68 or both. The electromagnetic pickup device 64 serves as a transducer transforming electromagnetic wave front 64 into an electrical signal using a plurality of electronic devices. The electrical signal may be sent to the surface on wire 70 that is attached to buoy 72 and onto platform 12 for further processing via wire 74. Upon reaching platform 12, the information originally obtained by sensors 40 is further processed making any necessary calculations and error corrections such that the information may be displayed in a usable format.

Even though FIG. 1 depicts repeaters 34, 36 in an offshore environment, it should be understood by one skilled in the art that repeaters 34, 36 are equally well-suited for operation in an onshore environment. In fact, in an onshore environment, electromagnetic pickup device 64 would be placed directly on the land surface. Alternatively, a receiver such as receiver 48 or receiver 56 could be used at the surface to pick up the electromagnetic wave fronts for processing at the surface.

Additionally, while FIG. 1 has been described with reference to transmitting information uphole during a measurement while drilling operation, it should be understood by one skilled in the art that repeaters 34, 36 may be used in conjunction with the transmission of information downhole from surface equipment to downhole tools to perform a variety of functions such as opening and closing a downhole tester valve or controlling a downhole choke.

Further, even though FIG. 1 has been described with reference to one way communication from the vicinity of drill bit 32 to platform 12, it should be understood by one skilled in the art that the principles of the present invention are applicable to two way communication. For example, a surface installation may be used to request downhole pressure, temperature, or flow rate information from formation 14 by sending electromagnetic wave fronts downhole which would again be amplified as described above with reference to repeaters 34, 36. Sensors, such as sensors 40, located near formation 14 receive this request and obtain the appropriate information which would then be returned to the surface via electromagnetic wave fronts which would again be amplified as described above with reference to repeaters 34, 36. As such, the phrase "between surface equipment and downhole equipment" as used herein encompasses the transmission of information from surface equipment downhole, from downhole equipment uphole or for two way communication.

Whether the information is being sent from the surface to a downhole destination or a downhole location to the surface, electromagnetic wave fronts such as electromagnetic wave fronts 46, 54, 62 may be radiated at varying frequencies such that the appropriate receiving device such as receivers 48, 56 or electromagnetic pickup device 64 will recognize that the electromagnetic wave fronts being sensed are intended for that device. In addition, each repeater 34, 36 includes a blocking switch which prevents receivers 48, 56 from receiving signals while transmitters 52, 60 are transmitting.

Figure 2A:
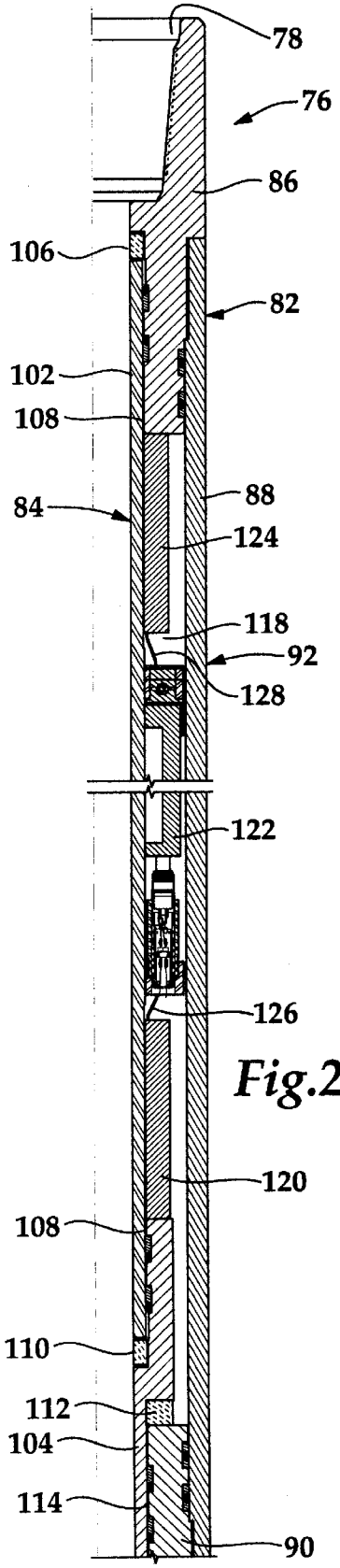
FIGS. 2A–2B are quarter-sectional views of an electromagnetic signal repeater of the present invention.
Figure 2B:
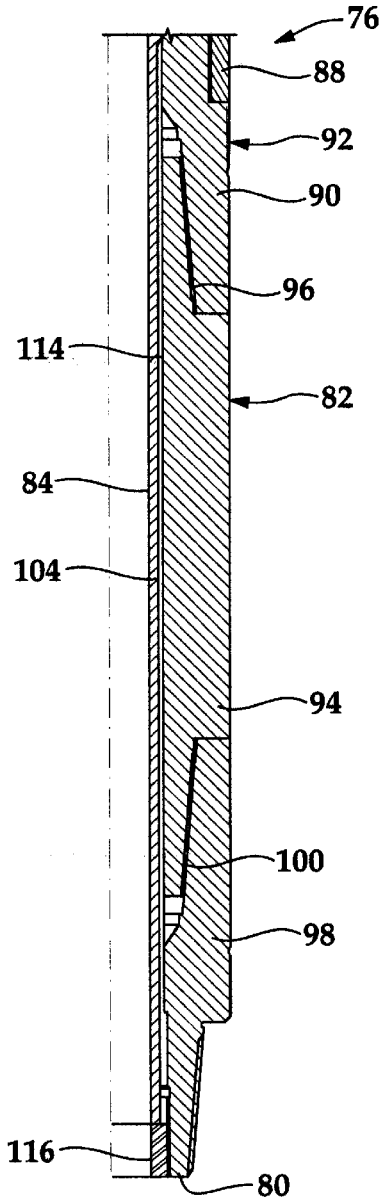

Representatively illustrated in FIGS. 2A–2B is one embodiment of an electromagnetic signal repeater 76 of the present invention. For convenience of illustration, FIGS. 2A–2B depict repeater 76 in a quarter sectional view. Repeater 76 has a box end 78 and a pin end 80 such that repeater 76 is threadably adaptable to drill string 30. Repeater 76 has an outer housing 82 and a mandrel 84 having a full bore so that when repeater 76 is interconnected with drill string 30, fluids may be circulated therethrough and therearound. Specifically, during a drilling operation, drilling mud is circulated through drill string 30 inside mandrel 84 of repeater 76 to ports formed through drill bit 32 and up the annulus formed between drill string 30 and wellbore 38 exteriorly of housing 82 of repeater 76. Housing 82 and mandrel 84 thereby protect to operable components of repeater 76 from drilling mud or other fluids disposed within wellbore 38 and within drill string 30.

Housing 82 of repeater 76 includes an axially extending and generally tubular upper connecter 86 which has box end 78 formed therein. Upper connecter 86 may be threadably and sealably connected to drill string 30 for conveyance into wellbore 38.

An axially extending generally tubular intermediate housing member 88 is threadably and sealably connected to upper connecter 86. An axially extending generally tubular lower housing member 90 is threadably and sealably connected to intermediate housing member 88. Collectively, upper connecter 86, intermediate housing member 88 and lower housing member 90 form upper subassembly 92. Upper subassembly 92, including upper connecter 86, intermediate housing member 88 and lower housing member 90, is electrically connected to the section of drill string 30 above repeater 76.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as aluminum oxide, chosen for its dielectric properties and capably of withstanding compression loads without extruding.

An axially extending generally tubular lower connecter 98 is securably and sealably coupled to isolation subassembly 94. Disposed between lower connecter 98 and isolation subassembly 94 is a dielectric layer 100 that electrically isolates lower connecter 98 from isolation subassembly 94. Lower connecter 98 is adapted to threadably and sealably connect to drill string 30 and is electrically connected to the portion of drill string 30 below repeater 76.

Isolation subassembly 94 provides a discontinuity in the electrical connection between lower connecter 98 and upper subassembly 92 of repeater 76, thereby providing a discontinuity in the electrical connection between the portion of drill string 30 below repeater 76 and the portion of drill string 30 above repeater 76.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that repeater 76 may be operated in vertical, horizontal, inverted or inclined orientations without deviating from the principles of the present invention.

Mandrel 84 includes axially extending generally tubular upper mandrel section 102 and axially extending generally tubular lower mandrel section 104. Upper mandrel section 102 is partially disposed and sealing configured within upper connecter 86. A dielectric member 106 electrically isolates upper mandrel section 102 from upper connecter 86. The outer surface of upper mandrel section 102 has a dielectric layer disposed thereon. Dielectric layer 108 may be, for example, a teflon layer. Together, dielectric layer 108 and dielectric member 106 serve to electrically isolate upper connecter 86 from upper mandrel section 102.

Between upper mandrel section 102 and lower mandrel section 104 is a dielectric member 110 that, along with dielectric layer 108 serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112 provide for electric isolation of lower mandrel section 104 from lower housing number 90. Dielectric layer 114 also provides for electric isolation between lower mandrel section 104 and isolation subassembly 94 as well as between lower mandrel section 104 and lower connecter 98. Lower end 116 of lower mandrel section 104 is disposed within lower connecter 98 and is in electrical communication with lower connecter 98.

Intermediate housing member 88 of outer housing 82 and upper mandrel section 102 of mandrel 84 define annular area 118. A receiver 120, an electronics package 122 and a transmitter 124 are disposed within annular area 118. In operation, receiver 120 receives an electromagnetic input signal carrying information which is transformed into a electrical signal that is passed onto electronics package 122 via electrical conductor 126, as will be more fully described with reference to FIG. 4. Electronics package 122 processes and amplifies the electrical signal which is then fed to transmitter 124 via electrical conductor 128, as will be more fully described with reference to FIG. 4. Transmitter 124 transforms the electrical signal into an electromagnetic output signal that is radiated into the earth carrying information.

Figure 3A:
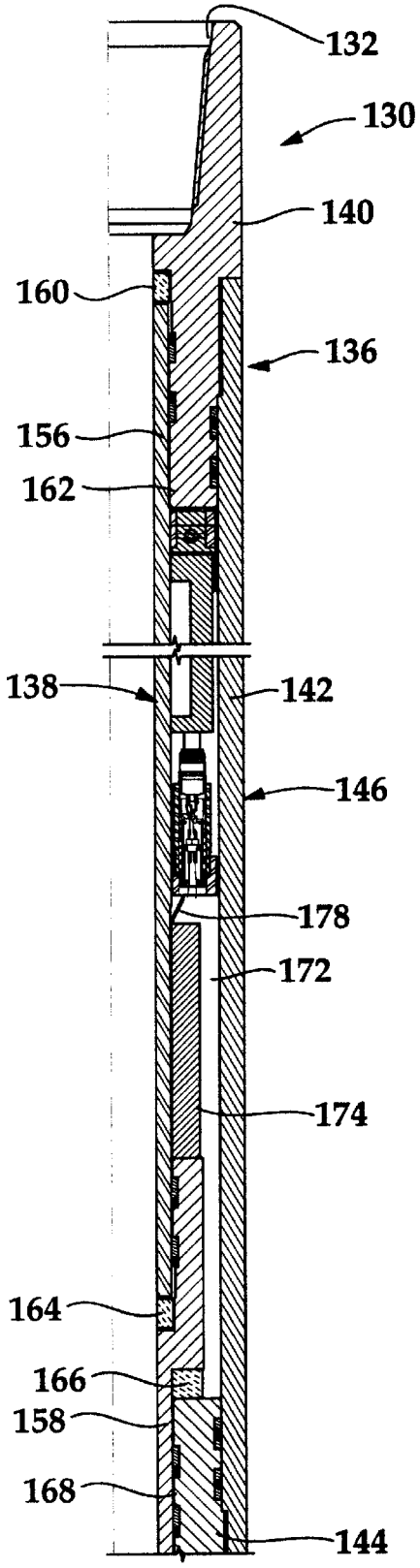
FIGS. 3A–3B are quarter-sectional views of an electromagnetic signal repeater of the present invention.
Figure 3B:
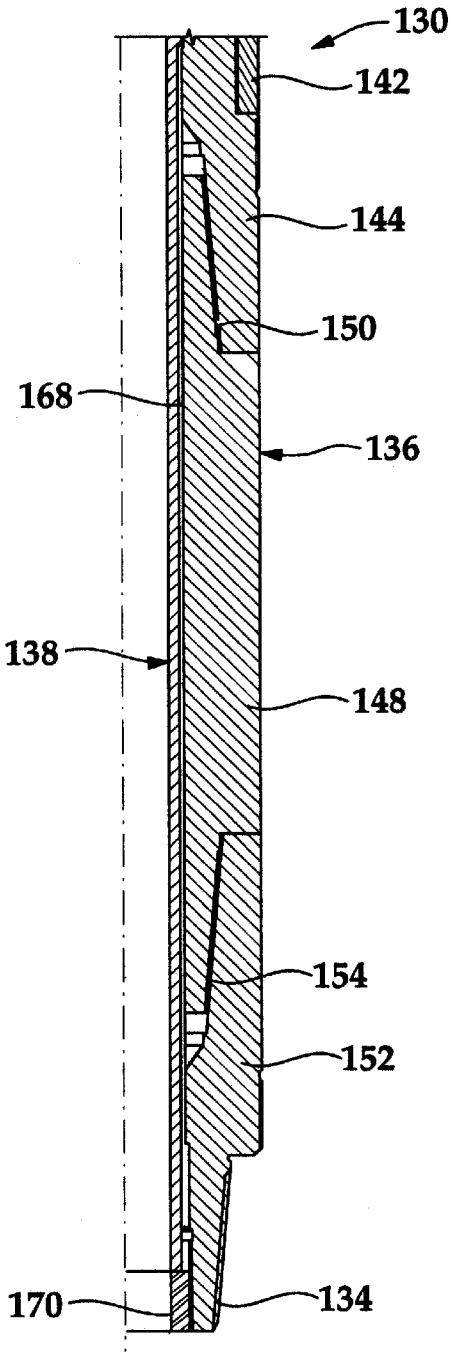

Representatively illustrated in FIGS. 3A–3B is another embodiment of an electromagnetic signal repeater 130 of the present invention. For convenience of illustration, FIGS. 3A–3B depict repeater 130 in a quarter sectional view. Repeater 130 has a box end 132 and a pin end 134 such that repeater 130 is threadably adaptable to drill string 30. Repeater 130 has an outer housing 136 and a mandrel 138 such that repeater 130 may be interconnected with drill string 30 providing a circulation path for fluids therethrough and therearound. Housing 136 and mandrel 138 thereby protect to operable components of repeater 130 from drilling mud or other fluids disposed within wellbore 40 and within drill string 30.

Housing 136 of repeater 130 includes an axially extending and generally tubular upper connecter 140 which has box end 132 formed therein. Upper connecter 140 may be threadably and sealably connected to drill string 30 for conveyance into wellbore 40.

An axially extending generally tubular intermediate housing member 142 is threadably and sealably connected to upper connecter 140. An axially extending generally tubular lower housing member 144 is threadably and sealably connected to intermediate housing member 142. Collectively, upper connecter 140, intermediate housing member 142 and lower housing member 144 form upper subassembly 146. Upper subassembly 146, including upper connecter 140, intermediate housing member 142 and lower housing member 144, is electrically connected to the section of drill string 30 above repeater 130.

An axially extending generally tubular isolation subassembly 148 is securably and sealably coupled to lower housing member 144. Disposed between isolation subassembly 148 and lower housing member 144 is a dielectric layer 150 that provides electric isolation between lower housing member 144 and isolation subassembly 148. Dielectric layer 150 is composed of a dielectric material chosen for its dielectric properties and capably of withstanding compression loads without extruding.

An axially extending generally tubular lower connecter 152 is securably and sealably coupled to isolation subassembly 148. Disposed between lower connecter 152 and isolation subassembly 148 is a dielectric layer 154 that electrically isolates lower connecter 152 from isolation subassembly 148. Lower connecter 152 is adapted to threadably and sealably connect to drill string 30 and is electrically connected to the portion of drill string 30 below repeater 130.

Isolation subassembly 148 provides a discontinuity in the electrical connection between lower connecter 152 and upper subassembly 146 of repeater 130, thereby providing a discontinuity in the electrical connection between the portion of drill string 30 below repeater 130 and the portion of drill string 30 above repeater 130.

Mandrel 138 includes axially extending generally tubular upper mandrel section 156 and axially extending generally tubular lower mandrel section 158. Upper mandrel section 156 is partially disposed and sealing configured within upper connecter 140. A dielectric member 160 electrically isolates upper mandrel section 156 and upper connecter 140. The outer surface of upper mandrel section 156 has a dielectric layer disposed thereon. Dielectric layer 162 may be, for example, a teflon layer. Together, dielectric layer 162 and dielectric member 160 service to electrically isolate upper connecter 140 from upper mandrel section 156.

Between upper mandrel section 156 and lower mandrel section 158 is a dielectric member 164 that, along with dielectric layer 162 serves to electrically isolate upper mandrel section 156 from lower mandrel section 158.

Between lower mandrel section 158 and lower housing member 144 is a dielectric member 166. On the outer surface of lower mandrel section 158 is a dielectric layer 168 which, along with dielectric member 166 provide for electric isolation of lower mandrel section 158 with lower housing number 144. Dielectric layer 168 also provides for electric isolation between lower mandrel section 158 and isolation subassembly 148 as well as between lower mandrel section 158 and lower connecter 152. Lower end 170 of lower mandrel section 158 is disposed within lower connecter 152 and is in electrical communication with lower connecter 152.

Intermediate housing member 142 of outer housing 136 and upper mandrel section 156 of mandrel 138 define annular area 172. A receiver and transmitter member 174 and an electronics package 176 are disposed within annular area 172. In operation, receiver and transmitter member 174 receives an electromagnetic input signal carrying information which is transformed into an electrical signal that is passed onto electronics package 176 via electrical conductor 178. Electronics package 122 processes and amplifies the electrical signal which is fed back to receiver and transmitter member 174 via electrical conductor 178. Receiver and transmitter member 174 transforms the electrical signal into an electromagnetic output signal that is radiated into the earth carrying information.

Figure 4A:
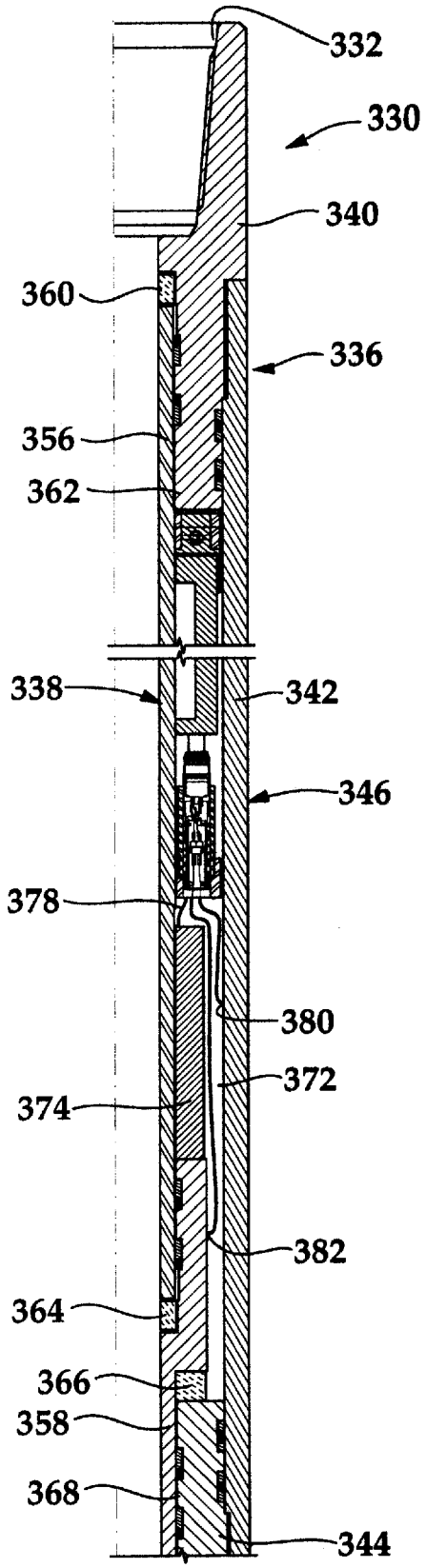
FIG. 4A–4B are quarter-sectional views of an electromagentic signal repeater of the present invention.
Figure 4B:
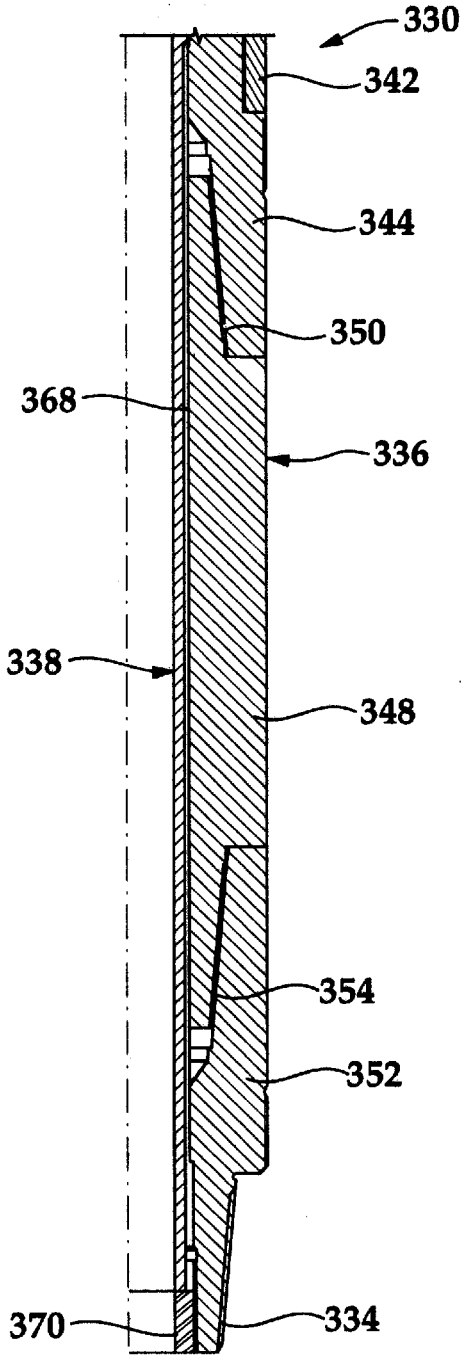

Representatively illustrated in FIGS. 4A–4B is another embodiment of an electromagnetic signal repeater 330 of the present invention. For convenience of illustration, FIGS. 4A–4B depicted repeater 330 in a quarter sectional view. Repeater 330 has a box end 332 and a pin end 334 such that repeater 330 is threadably adaptable to drill string 30. Repeater 330 has an outer housing 336 and a mandrel 338 such that repeater 330 may be interconnected with drill string 30 providing a circulation path for fluids therethrough and therearound. Housing 336 and mandrel 338 thereby protect to operable components of repeater 330 from drilling mud or other fluids disposed within wellbore 40 and within drill string 30.

Housing 336 of repeater 330 includes an axially extending and generally tubular upper connecter 340 which has box end 332 formed therein. Upper connecter 340 may be threadably and sealably connected to drill string 30 for conveyance into wellbore 40.

An axially extending generally tubular intermediate housing member 342 is threadably and sealably connected to upper connecter 340. An axially extending generally tubular lower housing member 344 is threadably and sealably connected to intermediate housing member 342. Collectively, upper connecter 340, intermediate housing member 342 and lower housing member 344 form upper subassembly 346. Upper subassembly 346, including upper connecter 340, intermediate housing member 342 and lower housing member 344, is electrically connected to the section of drill string 30 above repeater 330.

An axially extending generally tubular isolation subassembly 348 is securably and sealably coupled to lower housing member 344. Disposed between isolation subassembly 348 and lower housing member 344 is a dielectric layer 350 that provides electric isolation between lower housing member 344 and isolation subassembly 348. Dielectric layer 350 is composed of a dielectric material chosen for its dielectric properties and capably of withstanding compression loads without extruding.

An axially extending generally tubular lower connecter 352 is securably and sealably coupled to isolation subassembly 348. Disposed between lower connecter 352 and isolation subassembly 348 is a dielectric layer 354 that electrically isolates lower connecter 352 from isolation subassembly 348. Lower connecter 352 is adapted to threadably and sealably connect to drill string 30 and is electrically connected to the portion of drill string 30 below repeater 330.

Isolation subassembly 348 provides a discontinuity in the electrical connection between lower connecter 352 and upper subassembly 346 of repeater 330, thereby providing a discontinuity in the electrical connection between the portion of drill string 30 below repeater 330 and the portion of drill string 30 above repeater 330.

Mandrel 338 includes axially extending generally tubular upper mandrel section 356 and axially extending generally tubular lower mandrel section 358. Upper mandrel section 356 is partially disposed and sealing configured within upper connecter 340. A dielectric member 360 electrically isolates upper mandrel section 356 and upper connecter 340. The outer surface of upper mandrel section 356 has a dielectric layer disposed thereon. Dielectric layer 362 may be, for example, a teflon layer. Together, dielectric layer 362 and dielectric member 360 service to electrically isolate upper connecter 340 from upper mandrel section 356.

Between upper mandrel section 356 and lower mandrel section 358 is a dielectric member 364 that, along with dielectric layer 362 serves to electrically isolate upper mandrel section 356 from lower mandrel section 358. Between lower mandrel section 358 and lower housing member 344 is a dielectric member 366. On the outer surface of lower mandrel section 358 is a dielectric layer 368 which, along with dielectric member 366 provide for electric isolation of lower mandrel section 358 with lower housing number 344. Dielectric layer 368 also provides for electric isolation between lower mandrel section 358 and isolation subassembly 348 as well as between lower mandrel section 358 and lower connecter 352. Lower end 370 of lower mandrel section 358 is disposed within lower connecter 352 and is in electrical communication with lower connecter 352.

Intermediate housing member 342 of outer housing 336 and upper mandrel section 356 of mandrel 338 define annular area 372. A receiver 374 and an electronics package 376 are disposed within annular area 372. In operation, receiver 374 receives an electromagnetic input signal carrying information which is transformed into an electrical signal that is passed onto electronics package 376 via electrical conductor 378. Electronics package 322 processes and amplifies the electrical signal. An output voltage is then applied between intermediate housing member 342 and lower mandrel section 358, which is electrically isolated from intermediate housing member 342 and electrically connected to lower connector 352, via terminal 380 on intermediate housing member 342 and terminal 382 on lower mandrel section 358. The voltage applied between intermediate housing member 342 and lower connector 352 generates the electromagnetic output signal that is radiated into the earth carrying information.

Figure 5:
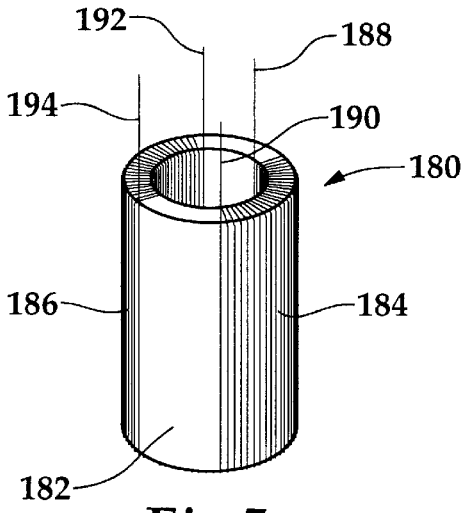
FIG. 5 is a schematic illustration of a toroid having primary and secondary windings wrapped therearound for an electromagnetic signal repeater of the present invention.

Referring now to FIG. 5, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary of the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings.

Toroid 180 of the present invention may serve as the receivers and transmitters as described with reference to FIGS. 1, 2 and 4 such as receivers 48, 56, 120, 374 and transmitters 44, 52, 60 and 124. Toroid 180 of the present invention may also serve as the receiver and transmitter member 174 as described with reference to FIG. 3. The following description of the orientation of windings 184 and windings 186 will therefore be applicable to receivers 48, 56, 120, 374, transmitters 44, 52, 60, 124 and receiver and transmitter member 174.

With reference to FIGS. 2 and 5, windings 184 have a first end 188 and a second end 190. First end 188 of windings 184 is electrically connected to electronics package 122. When toroid 180 serves as receiver 120, windings 184 serve as the secondary wherein first end 188 of windings 184 feeds electronics package 122 with an electrical signal via electrical conductor 126. The electrical signal is processed by electronics package 122 as will be further described with reference to FIGS. 8 and 10 below. When toroid 180 serves as transmitter 124, windings 184 serve as the primary wherein first end 188 of windings 184, receives an electrical signal from electronics package 122 via electrical conductor 128. Second end 190 of windings 184 is electrically connected to upper subassembly 92 of outer housing 82 which serves as a ground.

Windings 186 of toroid 180 have a first end 192 and a second end 194. First end 192 of windings 186 is electrically connected to upper subassembly 92 of outer housing 82. Second end 194 of windings 186 is electrically connected to lower connecter 98 of outer housing 82. First end 192 of windings 186 is thereby separated from second end 192 of windings 186 by isolations subassembly 94 which prevents a short between first end 192 and second end 194 of windings 186.

When toroid 180 serves as receiver 120, electromagnetic wave fronts, such as electromagnetic wave fronts 46 induce a current in windings 186, which serve as the primary. The current induced in windings 186 induces a current in windings 184, the secondary, which feeds electronics package 122 as described above. When toroid 180 serves as transmitter 124, the current supplied from electronics package 122 feeds windings 184, the primary, such that a current is induced in windings 186, the secondary. The current in windings 186 induces an axial current on drill string 30, thereby producing electromagnetic waves.

Due to the ratio of primary windings to secondary windings, when toroid 180 serves as receiver 120, the signal carried by the current induced in the primary windings is increased in the secondary windings. Similarly, when toroid 180 serves as transmitter 124, the current in the primary windings is increased in the secondary windings.

Figure 6:
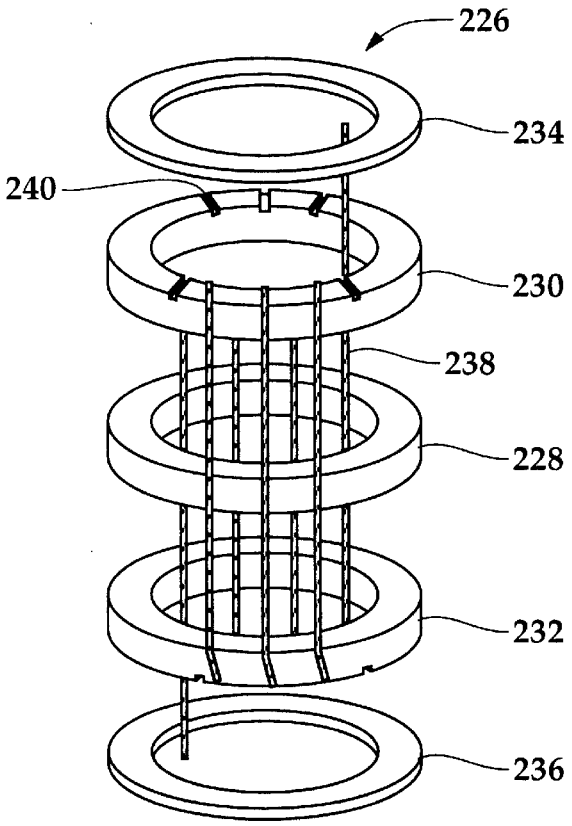
FIG. 6 is an exploded view of one embodiment of a toroid for use as a receiver in an electromagnetic signal repeater of the present invention.

Referring now to FIG. 6, an exploded view of a toroid assembly 226 is depicted. Toroid assembly 226 may be designed to serve, for example, as receiver 120. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 7:
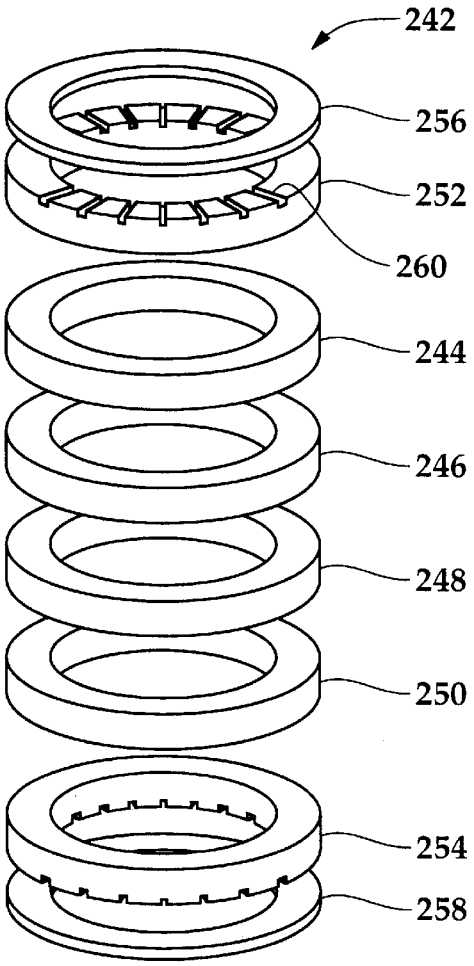
FIG. 7 is an exploded view of one embodiment of a toroid for use as a transmitter in an electromagnetic signal repeater of the present invention.

FIG. 7 depicts an exploded view of toroid assembly 242 which may serve, for example, as transmitter 124 of FIG. 2. Toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

As is apparent from FIGS. 6 and 7, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238.

Figure 8:
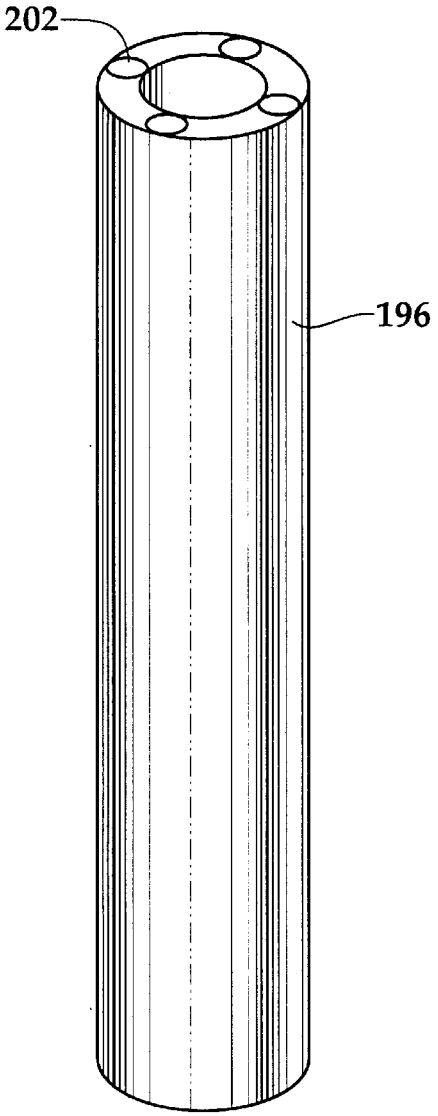
FIG. 8 is a perspective view of an annular carrier of an electronics package for an electromagnetic signal repeater of the present invention.
Figure 9:
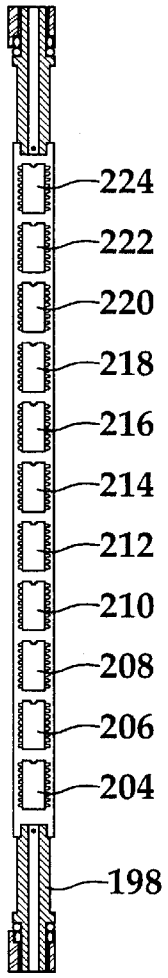
FIG. 9 is a perspective view of an electronics member having a plurality of electronic devices thereon for an electromagnetic signal repeater of the present invention.
Figure 10:
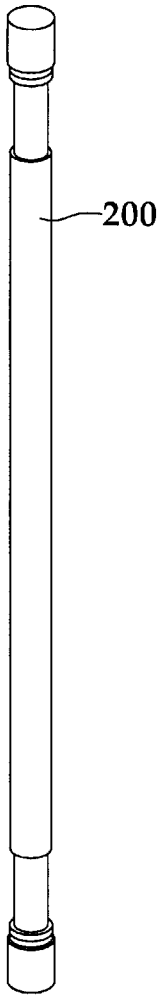
FIG. 10 is a perspective view of a battery pack for an electromagnetic signal repeater of the present invention.

Turning next to FIGS. 8, 9 and 10 collectively and with reference to FIG. 2, therein is depicted the components of electronics package 122 of the present invention. Electronics package 122 includes an annular carrier 196, an electronics member 198 and one or more battery packs 200. Annular carrier 196 is disposed between outer housing 82 and mandrel 84. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 which will be required for a specific implementation of electromagnetic signal repeater 76 of the present invention.

Electronics member 198 is insertable into an axial opening 202 of annular carrier 196. Electronics member 198 receives an electrical signal from first end 188 of windings 184 when toroid 180 serves as receiver 120. Electronics member 198 includes a plurality of electronic devices such as a preamplifier 204, a limiter 206, an amplifier 208, a notch filter 210, a high pass filter 212, a low pass filter 214, a frequency to voltage converter 216, voltage to frequency converter 218, amplifiers 220, 222, 224. The operation of these electronic devices will be more full discussed with reference to FIG. 11.

Battery packs 200 are insertable into axial openings 202 of axial carrier 196. Battery packs 200, which includes batteries such as nickel cadmium batteries or lithium batteries, are configured to provide the proper operating voltage and current to the electronic devices of electronics member 198 and to for example toroid 180 of FIG. 5.

Even though FIGS. 8–10 have described electronics package 122 with reference to annular carrier 196, it should be understood by one skilled in the art that a variety of configurations may be used for the construction of electronics package 122. For example, electronics package 122 may be positioned concentrically within mandrel 84 using several stabilizers and having a narrow, elongated shape such that a minimum resistance will be created by electronics package 122 to the flow of fluids within drill string 30.

Figure 11:
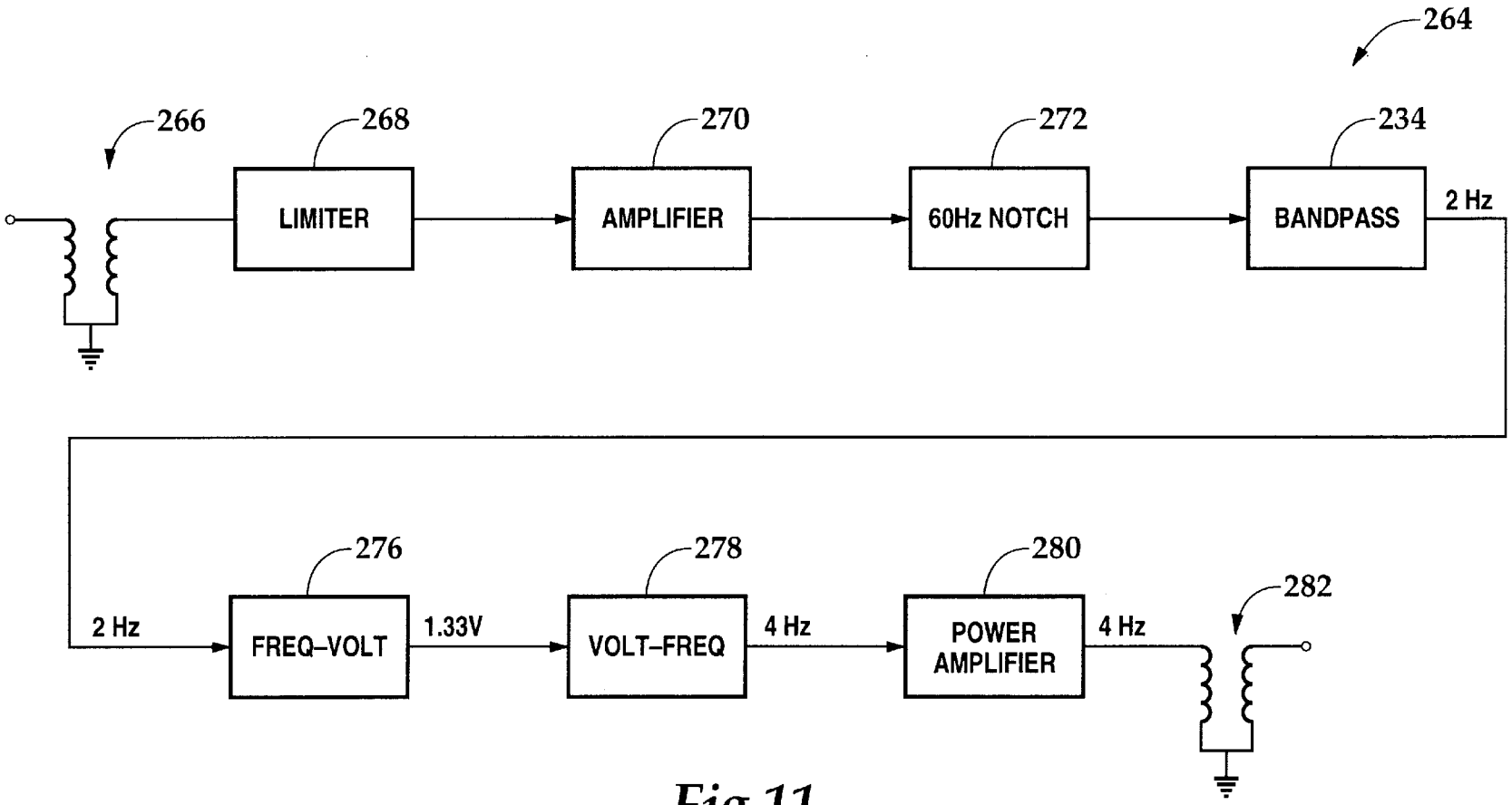
FIG. 11 is a block diagram of a signal processing method of an electromagnetic signal repeater of the present invention.

FIG. 11 is a block diagram of one embodiment of the method for processing the electrical signal by electronics package 122 which is generally designated 264. The method 264 utilizes a plurality of electronic devices such as those described with reference to FIG. 8. Method 264 is an analog pass through process that does not require modulation or demodulation, storage or other digital processing. Limiter 268 receives an electrical signal from receiver 266. Limiter 268 may include a pair of diodes for attenuating the noise to between about 0.3 and 0.8 volts. The electrical signal is then passed to amplifier 270 which may amplify the electrical signal to 5 volts. The electrical signal is then passed through a notch filter 272 to shunt noise in the 60 hertz range, a typical frequency for noise in an offshore application in the United States whereas a European application may have of 50 hertz notch filter. The electrical signal then enters a band pass filter 234 to attenuate high noise and low noise and to recreate a signal having the original frequency which was electromagnetically transmitted, for example, two hertz.

The electrical signal is then fed to a frequency to voltage converter 276 and a voltage to frequency converter 278 in order to shift the frequency of the electrical signal from, for example, 2 hertz to 4 hertz. This frequency shift allows each repeater to retransmit the information carried in the original electromagnetic signal at a different frequency. The frequency shift prevents multiple repeaters from attempting to interpret stray signals by orienting the repeaters such that each repeater will be looking for a different frequency or by sufficiently spacing repeaters along drill string 30 that are looking for a specific frequency.

After the electrical signal has a frequency shift, power amplifier 280 increases the signal which travels to transmitter 282. Transmitter 282 transforms the electrical signal into an electromagnetic signal which is radiated into the earth to another repeater as its final destination.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole electromagnetic signal repeater apparatus for communicating information between surface equipment and downhole equipment comprising:

a housing having first and second subassemblies, the first subassembly electrically isolated from the second subassembly;

a mandrel coaxially disposed within the housing, the mandrel electrically isolated from the first subassembly and electrically connected to the second subassembly;

a receiver coaxially disposed between the housing and the mandrel for receiving an electromagnetic input signal and transforming the electromagnetic input signal to an electrical signal;

an electronics package electrically connected to the receiver for amplifying the electrical signal; and a transmitter coaxially disposed between the housing and the mandrel and electrically connected to the electronics package for transforming the electrical signal to an electromagnetic output signal that is radiated into the earth.

2. The apparatus as recited in claim 1 wherein the receiver further comprises a magnetically permeable annular core, a plurality of primary electrical conductor windings wrapped axially around the annular core and a plurality of secondary electrical conductor windings wrapped axially around the annular core.

3. The apparatus as recited in claim 2 wherein one end of the plurality of secondary electrical conductor windings is electrically connected to the first subassembly and the other end of the plurality of secondary electrical conductor windings is electrically connected to the second subassembly such that a current is induced in the primary electrical conductor windings in response to the electromagnetic input signal.

4. The apparatus as recited in claim 3 wherein a current is induced in the plurality of secondary electrical conductor windings by the plurality of primary electrical conductor windings, thereby amplifying the electrical signal.

5. The apparatus as recited in claim 1 wherein the electronics package is disposed within the mandrel, the electronic package including at least one battery pack and a plurality of electronic devices.

6. The apparatus as recited in claim 1 wherein the electronics package further includes a annular carrier having a plurality of axial openings for receiving at least one battery pack and an electronics member having a plurality of electronic devices thereon, the annular carrier disposed between the housing and the mandrel.

7. The apparatus as recited in claim 1 wherein the electronics package is disposed within the mandrel and further includes at least one battery pack and an electronics member having a plurality of electronic devices thereon.

8. The apparatus as recited in claim 1 wherein the transmitter further comprises a magnetically permeable annular core, a plurality of primary electrical conductor windings wrapped axially around the annular core and a plurality of secondary electrical conductor windings wrapped axially around the annular core.

9. The apparatus as recited in claim 8 wherein a current is inputted in the plurality of primary electrical conductor windings from the electronics package.

10. The apparatus as recited in claim 9 wherein one end of the plurality of secondary electrical conductor windings is electrically connected to the first subassembly and the other end of the plurality of secondary electrical conductor windings is electrically connected to the second subassembly such that when a current is induced in the plurality of secondary electrical conductor windings by the plurality of primary electrical conductor windings, the electromagnetic output signal is radiated into the earth.

11. The apparatus as recited in claim 1 wherein the housing further includes an isolation subassembly between the first and second subassemblies, a first dielectric layer positioned between the isolation subassembly and the first subassembly and a second dielectric layer positioned between the isolation subassembly and the second subassembly, thereby electrically isolating the first subassembly from the second subassembly.

12. The apparatus as recited in claim 1 further comprising a dielectric member positioned between the first subassembly and the mandrel, thereby electrically isolating the first subassembly from the mandrel.

13. The apparatus as recited in claim 1 wherein the mandrel further includes a first section and a second section, the first section electrically isolated from the first subassembly and from the second section, the second section electrically isolated from the first subassembly and electrically connected to the second subassembly.

14. The apparatus as recited in claim 13 further comprising a first dielectric member positioned between the first subassembly and the first section, a second dielectric member positioned between the first section and the second section and a third dielectric member positioned between the second section and the second subassembly, thereby electrically isolating the first subassembly from the first and second sections and electrically isolating the first section from the second section.

15. A downhole electromagnetic signal repeater apparatus for communicating information between surface equipment and downhole equipment comprising:

a housing having first and second subassemblies, the first subassembly electrically isolated from the second subassembly;

a mandrel coaxially disposed within the housing, the mandrel electrically isolated from the first subassembly and electrically connected to the second subassembly;

a receiver and transmitter member coaxially disposed between the housing and the mandrel for receiving an electromagnetic input signal and transforming the electromagnetic input signal to an electrical signal and for transforming the electrical signal to an electromagnetic output signal that is radiated into the earth; and an electronics package electrically connected to the receiver and transmitter member for amplifying the electrical signal.

16. The apparatus as recited in claim 15 wherein the receiver and transmitter member further comprises a magnetically permeable annular core, a plurality of primary electrical conductor windings wrapped axially around the annular core and a plurality of secondary electrical conductor windings wrapped axially around the annular core.

17. The apparatus as recited in claim 16 wherein one end of the plurality of secondary electrical conductor windings is electrically connected to the first subassembly and the other end of the plurality of secondary electrical conductor windings is electrically connected to the second subassembly such that a current is induced in the primary electrical conductor windings in response to the electromagnetic input signal.

18. The apparatus as recited in claim 17 wherein a current is induced in the plurality of secondary electrical conductor windings by the plurality of primary electrical conductor windings, thereby amplifying the electrical signal.

19. The apparatus as recited in claim 16 wherein a current is inputted in the plurality of primary electrical conductor windings from the electronics package.

20. The apparatus as recited in claim 19 wherein one end of the plurality of secondary electrical conductor windings is electrically connected to the first subassembly and the other end of the plurality of secondary electrical conductor windings is electrically connected to the second subassembly such that when a current is induced in the plurality of secondary electrical conductor windings by the plurality of primary electrical conductor windings, the electromagnetic output signal is radiated into the earth.

21. The apparatus as recited in claim 15 wherein the electronics package is disposed within the mandrel and wherein the electronic package further includes at least one battery pack and a plurality of electronic devices.

22. The apparatus as recited in claim 15 wherein the electronics package further includes a annular carrier having a plurality of axial openings for receiving at least one battery pack and an electronics member having a plurality of electronic devices thereon, the annular carrier disposed between the housing and the mandrel.

23. The apparatus as recited in claim 15 wherein the electronics package is disposed within the mandrel and further includes at least one battery pack and an electronics member having a plurality of electronic devices thereon.

24. The apparatus as recited in claim 15 wherein the housing further includes an isolation subassembly between the first and second subassemblies, a first dielectric layer positioned between the isolation subassembly and the first subassembly and a second dielectric layer positioned between the isolation subassembly and the second subassembly, thereby electrically isolating the first subassembly from the second subassembly.

25. The apparatus as recited in claim 15 further comprising a dielectric member positioned between the first subassembly and the mandrel, thereby electrically isolating the first subassembly from the mandrel.

26. The apparatus as recited in claim 15 wherein the mandrel further includes a first section and a second section, the first section electrically isolated from the first subassembly and from the second section, the second section electrically isolated from the first subassembly and electrically connected to the second subassembly.

27. The apparatus as recited in claim 26 further comprising a first dielectric member positioned between the first subassembly and the first section, a second dielectric member positioned between the first section and the second section and a third dielectric member positioned between the second section and the second subassembly, thereby electrically isolating the first subassembly from the first and second sections and electrically isolating the first section from the second section.

28. A method for communicating electromagnetic signals carrying information between surface equipment and downhole equipment, the method comprising the steps of:

receiving an electromagnetic input signal on a receiver disposed within a wellbore;

transforming the electromagnetic input signal to an electrical signal;

sending the electrical signal to an electronics package;

providing energy to the electronics package from a battery pack;

processing the electrical signal through a plurality of electronic devices in the electronics package;

sending the electrical signal to a transmitter;

transforming the electrical signal to an electromagnetic output signal; and radiating the electromagnetic output signal into the earth.

29. The method as recited in claim 28 further comprising the steps of inducing current in a the receiver having a plurality of primary electrical conductor windings and amplifying the electromagnetic input signal by magnetically coupling the plurality of primary electrical conductor windings to a plurality of secondary electrical conductor windings.

30. The method as recited in claim 28 wherein the step of processing the electrical signal further comprises attenuating noise in the electrical signal to between about 0.3 and 0.8 volts.

31. The method as recited in claim 28 wherein the step of processing the electrical signal further comprises filtering out high frequency noise from the electrical signal.

32. The method as recited in claim 28 wherein the step of processing the electrical signal further comprises filtering out low frequency noise from the electrical signal.

33. The method as recited in claim 28 wherein the step of processing the electrical signal further comprises amplifying the electrical signal to remove noise.

34. The method as recited in claim 28 wherein the step of processing the electrical signal further comprises shifting the frequency of the electrical signal.

35. The method as recited in claim 28 further comprising the steps of inputting the electrical signal to the transmitter having a plurality of primary electrical conductor winding and inducing a current in a plurality of secondary electrical conductor windings by magnetically coupling the plurality of secondary electrical conductor windings to the plurality of primary electrical conductor windings, thereby producing the electromagnetic output signal.

36. A downhole electromagnetic signal repeater apparatus for communicating information between surface equipment and downhole equipment comprising:

a receiver receiving an electromagnetic input signal and transforming the electromagnetic input signal to an electrical signal;

an electronics package electrically connected to the receiver, the electronics package including at least one battery pack and a plurality of electronic devices, the electronics package amplifying the electrical signal; and a transmitter electrically connected to the electronics package transforming the electrical signal to an electromagnetic output signal that is radiated into the earth.

37. The apparatus as recited in claim 38 wherein the receiver further comprises a magnetically permeable annular core, a plurality of primary electrical conductor windings wrapped axially around the annular core and a plurality of secondary electrical conductor windings wrapped axially around the annular core.

38. The apparatus as recited in claim 37 wherein is induced in the primary electrical conductor windings in response to the electromagnetic input signal.

39. The apparatus as recited in claim 38 wherein a current is induced in the plurality of secondary electrical conductor windings by the plurality of primary electrical conductor windings, thereby amplifying the electrical signal.

40. The apparatus as recited in claim 36 wherein the transmitter further comprises a magnetically permeable annular core, a plurality of primary electrical conductor windings wrapped axially around the annular core and a plurality of secondary electrical conductor windings wrapped axially around the annular core.

41. The apparatus as recited in claim 40 wherein a current carrying the electrical signal is inputted in the plurality of primary electrical conductor windings from the electronics package.

42. The apparatus as recited in claim 41 wherein a current is induced in the plurality of secondary electrical conductor windings by the plurality of primary electrical conductor windings such that the electromagnetic output signal is radiated into the earth.

43. A downhole electromagnetic signal repeater apparatus for communicating information between surface equipment and downhole equipment comprising:

a receiver and transmitter member receiving an electromagnetic input signal and transforming the electromagnetic input signal to an electrical signal and transforming the electrical signal to an electromagnetic output signal that is radiated into the earth; and an electronics package electrically connected to the receiver and transmitter member, the electronics package including at least one battery pack and a plurality of electronic devices, the electronics package amplifying the electrical signal.

44. The apparatus as recited in claim 43 wherein the receiver and transmitter member further comprises a magnetically permeable annular core, a plurality of primary electrical conductor windings wrapped axially around the annular core and a plurality of secondary electrical conductor windings wrapped axially around the annular core.

45. The apparatus as recited in claim 44 wherein current is induced in the primary electrical conductor windings in response to the electromagnetic input signal.

46. The apparatus as recited in claim 45 wherein a current is induced in the plurality of secondary electrical conductor windings by the plurality of primary electrical conductor windings, thereby amplifying the electrical signal.

47. The apparatus as recited in claim 44 wherein a current is inputted in the plurality of primary electrical conductor windings from the electronics package.

48. The apparatus as recited in claim 47 wherein a current is induced in the plurality of secondary electrical conductor windings by the plurality of primary electrical conductor windings such that the electromagnetic output signal is radiated into the earth.

* * * * *